United States Patent [19]

Duchin

[11] 4,323,183

[45] Apr. 6, 1982

[54] TAG DISPENSER FOR HAND-HELD ATTACHER

[76] Inventor: Daniel Duchin, 1374 Blue Spruce La., Wantagh, Long Island City, N.Y. 11793

[21] Appl. No.: 114,955

[22] Filed: Jan. 24, 1980

[51] Int. Cl.[3] ..... B31F 7/00

[52] U.S. Cl. ..... 227/3; 221/215; 227/18; 227/40; 227/48; 227/67

[58] Field of Search ..... 221/215, 232, 242; 227/3, 18, 40, 48, 67, 76, 120

[56] References Cited

U.S. PATENT DOCUMENTS

| | | | |
|---|---|---|---|
| 2,331,252 | 10/1943 | Van Tuyl | 227/76 X |
| 3,012,484 | 12/1961 | Braun | 227/76 X |
| 3,022,508 | 2/1962 | Ruskin | 227/3 |
| 3,385,498 | 5/1968 | Downie | 227/18 |
| 3,595,460 | 7/1971 | Pitkin | 227/48 |
| 3,598,025 | 8/1971 | Cotton | 227/67 X |
| 3,898,725 | 8/1975 | Carter | 227/3 X |
| 3,948,128 | 4/1976 | Russell | 227/67 X |
| 4,040,555 | 8/1977 | Jenkins | 227/67 |

*Primary Examiner*—Paul A. Bell

*Attorney, Agent, or Firm*—James & Franklin

[57] ABSTRACT

The tag-dispensing device is designed for use with a hand-held plastic fastener attacher of the type having a needle for penetrating an article to be tagged and through which a fastener is dispensed. The device includes a support to which the attacher is movably mounted and upon which is situated a stack of tags. A slide is utilized to move a tag along the plane between the stack and a position in alignment with the needle of the attacher. The attacher is mounted to the support by a plate which is movable relative to the support between a position wherein the needle is remote from the plane of slide movement and a position wherein the needle intersects the plane. Slide movement may be accomplished manually or automatically in conjunction with the movement of the attacher by using a mechanical linkage, an electrically driven motor, a solenoid, or a pneumatic cylinder.

35 Claims, 11 Drawing Figures

FIG. 3
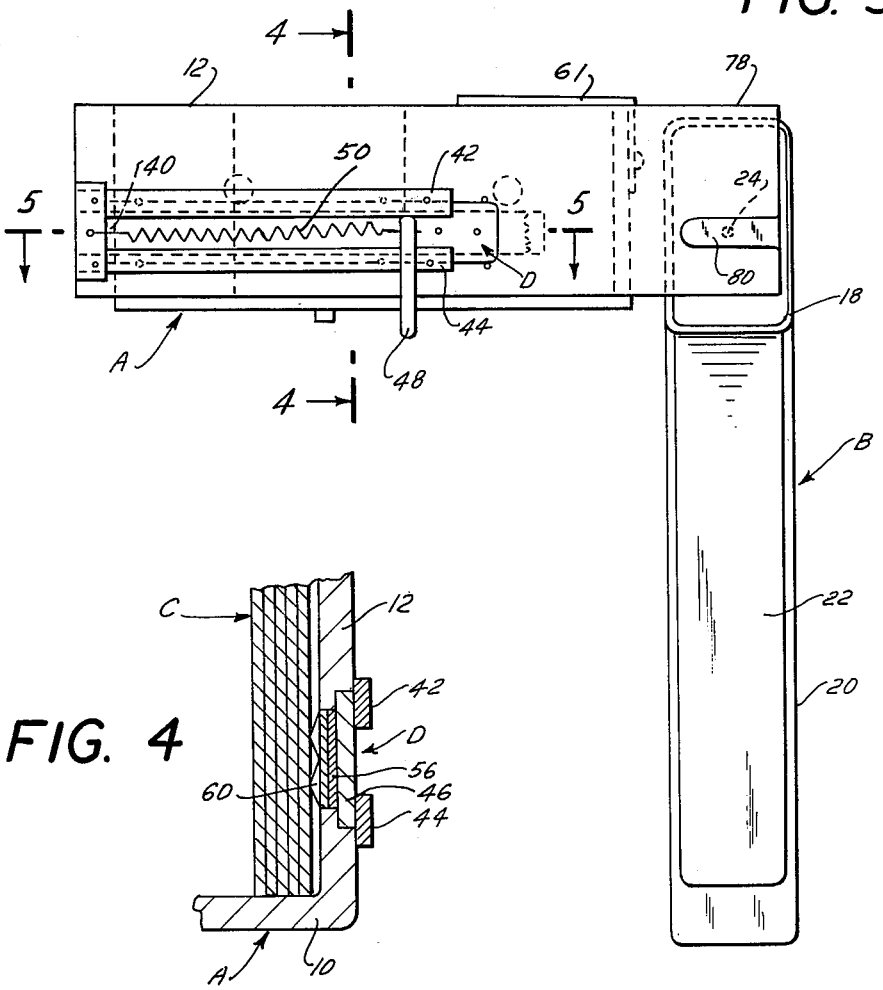
FIG. 4
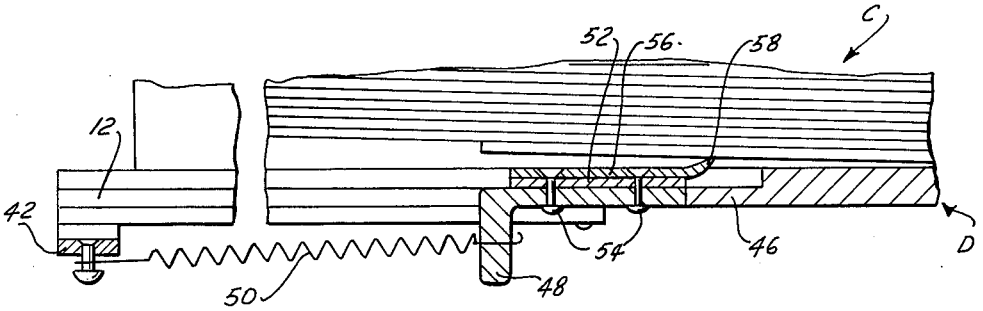
FIG. 5

TAG DISPENSER FOR HAND-HELD ATTACHER

The present invention relates to a tag dispensing device and, more particularly, to a tag dispensing device which is portable enough to be used in conjunction with a conventional hand-held plastic fastener attacher.

Plastic fasteners, such as the type sold by the Dennison Manufacturing Company of Framingham, Mass., under the trademarks SWIFTACHMENTS and SUPER SWIFTACHMENTS, are widely used in the retail industry throughout this country for attaching labels, tags and other identifying or information-containing objects to a wide variety of softgoods articles for inventory control and pricing purposes. Literally millions of these fasteners are applied to articles during the course of a year, most of which are applied by operators using manually actuated hand-held plastic fastener attachers or guns which are sold by a variety of companies for this purpose. Marking systems of this type have been highly commercially successful because of the low price of the fasteners, the ease and relatively low skill required for the attaching operation, and because of the security which is provided due to the structure of the fastener and the material from which it is made, which substantially reduces problems such as tag switching.

The tag switching procedure is quite simple. A magazine or clip of plastic fasteners is loaded into the attacher, which is held in one hand of the operator. The operator holds the tag against the article to be tagged in the other hand. The attacher is moved towards the article until the needle extending from the front of the attacher penetrates the tag and the article. The operator then actuates the attacher by depressing a trigger-like member such that a single plastic fastener is dispensed through the needle. The T-bar end of the fastener is thus situated behind the article with the filament penetrating the tag and article. The gun is then moved away from the article, withdrawing the needle thereform, and leaving the fastener in place with the filament of the fastener through a hole in the article and the tag, the T-bar end of the fastener lodged behind the article, and the paddle end of the fastener situated in front of the tag. As the operator releases the trigger, the next plastic fastener is moved into position such that the operation can be rapidly repeated.

Notwithstanding the fact that the plastic fasteners are quite inexpensive and, thus, the per unit tagging costs are low, the aggregate costs involved in the tagging operation are high because of the fact that virtually every article of softgoods which is sold must be tagged in this manner, requiring a great deal of time and labor. Users and manufacturers of this system are continually seeking methods of reducing the overall cost of the marking operation. The fasteners themselves and the attachers are highly engineered and there is little room for improvement thereof. However, an analysis of the tagging operation indicates that a significant portion of the time and motion required is a result of the necessity for the operator to remove the single tag from a stack of tags and place it in the required position with respect to the article, prior to the use of the attacher. Thus, a reduction in time and labor would result if the tag positioning operation could be facilitated.

Tag dispensing devices are known and have taken a variety of different forms. Such devices normally include a support upon which a stack of tags is mounted. A slide having a protrusion or finger extending therefrom is movable in a direction perpendicular to the axis of the stack. As the slide is moved, the protrusion or finger extending therefrom engages the rear edge of the first tag on the stack and moves the first tag on the stack to a position such that it extends outwardly from the support so that the fed tag can be removed therefrom. The stack is spring-loaded towards the slide such that when the slide is returned to its initial position, the finger or protrusion thereon engages the rear edge of the next tag on the stack.

Tag feeding devices have been designed for automatic actuation so that same can be utilized in conjunction with power actuated attachers such as the one disclosed in U.S. Pat. No. 3,898,725 issued to Joseph Carter on Aug. 12, 1975 and entitled "Apparatus For Applying Hangtags to Zippers". In the Carter device, the slide on the tag feeding device is pneumatically actuated as is the stapling machine used in conjunction therewith. However, all such devices heretofore known are designed only for non-portable operation as the size and weight thereof require that the device be mounted on a support such as a table or the like. Thus, the articles to be tagged must be brought to the device, requiring the removal from a rack or the like, thereby eliminating the advantage of the automatic tagging operation, particularly when large numbers of articles must be rapidly tagged. For this reason, such systems have found commercial application only when, in special instances, power actuated attachers are required because of the articles to be tagged being too thick or hard to be penetrated by the needle of a hand-held attacher.

The situation is further complicated when a tag feeding device is used in conjunction with a plastic fastener attacher of the type described above because not only must the tag be moved in alignment with the needle of the attacher, but the attacher and the fed tag must be moved relative to each other to achieve penetration of the needle through the tag, prior to actuation of the attacher. If this is done in a completely automated operation, a minimum of three separate power operations are required—one to feed the tag, a second to move the needle relative to the tag, to penetrate same, and a third to actuate the attacher to dispense a fastener. Because of these complications, tag feeding devices have rarely been used in conjunction with plastic fastener attachers and when same have been used, it is only in conjunction with table-mounted power actuated attachers. There has never been a device devised which is simple, small and lightweight enough to be used in conjunction with a hand-held attacher in a completely portable operation.

It is, therefore, a prime object of the present invention to provide a tag dispensing device portable enough for use in conjunction with a hand-held attacher.

It is another object of the present invention to provide a tag dispenser designed for use with a commercially available hand-held plastic fastener attacher.

It is another object of the present invention to provide a tag dispenser for a handheld attacher wherein the attacher is manually movable relative to the tag stack support to permit penetration of the needle through the tag.

It is another object of the present invention to provide a tag dispenser for a hand-held attacher wherein positive engagement between the face of a tag and the tag dispensing slide provides reliable tag positioning.

It is another object of the present invention to provide a tag dispenser for a hand-held attacher wherein a variety of different size and shape tags may be accommodated.

It is another object of the present invention to provide a tag dispenser for a hand-held attacher wherein the tag dispensing slide may be manually actuated.

It is another object of the present invention to provide a tag dispenser for a hand-held attacher wherein the tag dispensing slide may be electrically actuated.

It is another object of the present invention to provide a tag dispenser for a hand-held attacher wherein the tag dispensing slide is pneumatically actuated.

It is another object of the present invention to provide a tag dispenser for a hand-held attacher wherein the leading edge of the tag is prevented from engaging the slide frame as the tag is fed.

It is a further object of the present invention to provide a tag dispenser for a hand-held attacher which is constructed of relatively simple, inexpensive, lightweight parts which function together reliably with a minimum of maintenance.

In accordance with the present invention, a tag feeding device for use in conjunction with a hand-held plastic fastener attacher is provided. The attacher is of the type having a needle for penetrating an article to be tagged and for dispensing a fastener. The device comprises a support, means for mounting an attacher to the support, and means for mounting a stack of tags on the support. Means are provided for transferring the tag along a plane between a first position, aligned with the stack mounting means, and a second position where the tag is aligned with the needle of the attacher. The attacher mounting means includes means for permitting movement of the attacher relative to the support between a first position, wherein the needle is remote from the plane of tag movement and a second position, wherein the needle intersects the plane of tag movement.

The plane of tag movement and the direction of attacher movement with respect to the support are substantially perpendicular. The tag is moved to its second position, in alignment with the needle of the attacher, when the attacher is in its first position with the needle remote from the plane of tag movement. The attacher is then moved to the second position where the needle intersects the plane of tag movement such that the needle penetrates the tag. Once the needle penetrates the tag, the slide, which was previously latched in its second position, is returned to its initial position. After the attacher is actuated and the fastener and tag removed therefrom, the attacher returns to its first position, where the needle is remote from the plane of tag movement and the slide is again moved to feed the next tag into position with respect to the attacher.

The attacher mounting means comprises a member which is slideably mounted on the support for movement between first and second positions. Means are provided for fixedly mounting a conventional hand-held plastic fastener attacher to the member. Means are also provided for urging the member towards the first position, such that after release of forward pressure on the attacher as the attaching operation is completed, the attacher will automatically move with respect to the support to a position to permit the feeding of the next tag in alignment therewith.

The support includes a part oriented along a direction substantially parallel to the direction of attacher movement. A channel is provided on this part within which the member is received. This part has a portion thereof adjacent to the plane of tag movement. This portion has a corner with a cut-away section to provide clearance for the leading edge of the tag, as the tag dispensing slide is moved towards its second position.

The tag transfer means comprises a slide and a slide mounting means in the form of a frame member mounted on the support and extending between the stack mounting means and a position aligned with the axis of the needle. A tag abutment means forms a part of the frame member, is mounted in alignment with the axis of the needle, and is provided with an opening therein for needle clearance. The tag abutment means serves to support a dispensed tag as the attacher is moved towards the second position, such that the needle may penetrate the tag and be received through the opening in the tag abutment means. A slot is provided on the tag abutment means, extending from the periphery thereof to the opening. The slot permits the fastener, and thus the tag mounted thereon, to be removed from the device with a single, simple motion.

The tag dispensing slide includes an element and a tag engaging finger mounted on the element. The element is provided with an elongated slot and means for adjustably positioning the finger along the slot such that the position of the finger with respect to the slide may be altered to accommodate different size and shaped tags.

The finger itself includes a base and means, mounted on the finger base, for engaging the face or front surface of the tag. The base preferably comprises a leaf spring or the like and the tag surface engaging means comprises a tooth extending from the finger base in a direction towards the stack mounting means. Preferably, the surface engaging tooth is integrally formed with the finger base. The tag surface engaging means may also comprise a plurality of teeth mounted on the finger base in side-by-side relation, such as would be formed by bifuricating or serrating a section of the finger base.

The stack mounting means comprises means for supporting the bottom of the stack and means for supporting one side of the stack. The top and other side of the stack have no confining structure, except for an adjustably positionable top member. In this manner, a variety of different size and shape tags may be accommodated without altering the structure of the stack mounting means.

The stack mounting means also includes means for urging the stack towards the slide. The urging means includes a first spring-loaded plate and means for orienting the first plate in a plane substantially parallel to the plane of movement of the slide. A second plate is located adjacent to the rear of the stack and means are provided for pivotally mounting the second plate to the first plate. Pivotally mounting the second plate to the first plate permits the stack to pivot to a limited extent with respect to the support to prevent jamming of the slide. The first plate orienting means comprises means for guiding the first plate for movement along the support in a direction substantially parallel to the movement of the attacher.

Means are provided for moving the slide from the first and second position. Means are provided for latching the slide in the second position of the tag until the attacher is moved to its second position wherein the needle penetrates the tag. Means are provided for returning the slide to the first position when the attacher is in its second position. The slide is maintained in the first position by spring means until the tag is removed from the device and the attacher is returned to its first position.

In one embodiment, the slide is moved manually and the slide moving means comprises a part which may be engaged by the hand of the operator. In this instance, a mechanical latching device is utilized. In another embodiment of the present invention, the slide is moved by a pneumatic cylinder which is controlled by an electrical valve, in turn, energized by a latching relay, or by pneumatic valves. In another embodiment of the present invention, the slide is moved by a solenoid which is energized by a latching relay. In still another embodiment of the present invention, the slide is moved by a motor which is energized by a latching relay.

To the objects as set forth above, and to such other objects as may hereinafter appear, the present invention relates to a tag dispenser for a hand-held attacher, as set forth in the following specification and recited in the annexed claims, taken together with the accompanying drawings, wherein like numerals refer to like parts, and in which:

FIG. 3 is a front view of the device illustrated in FIG. 1;

FIG. 4 is a cross-sectional view, taken along line 4—4 of FIG. 3;

FIG. 5 is a cross-sectional view taken along line 5—5 of FIG. 3;

The basic device of the present invention is illustrated in FIGS. 1–6. In general, the device includes a support, generally designated A, to which a hand-held plastic fastener attacher, generally designated B, is movably mounted. Upon support A is situated a stack of tags, generally designated C. Slide means, generally designated D, are utilized to move a tag along the plane between the tag stack C and a position in alignment with the needle of the attacher B. Means, generally designated E, are provided for mounting attacher B to support A in a manner which permits attacher B to be moved relative to support A between an initial or first position, wherein the needle is remote from the plane of tag movement, and a final or second position, wherein the needle intersects the plane of tag movement.

Figure 2:
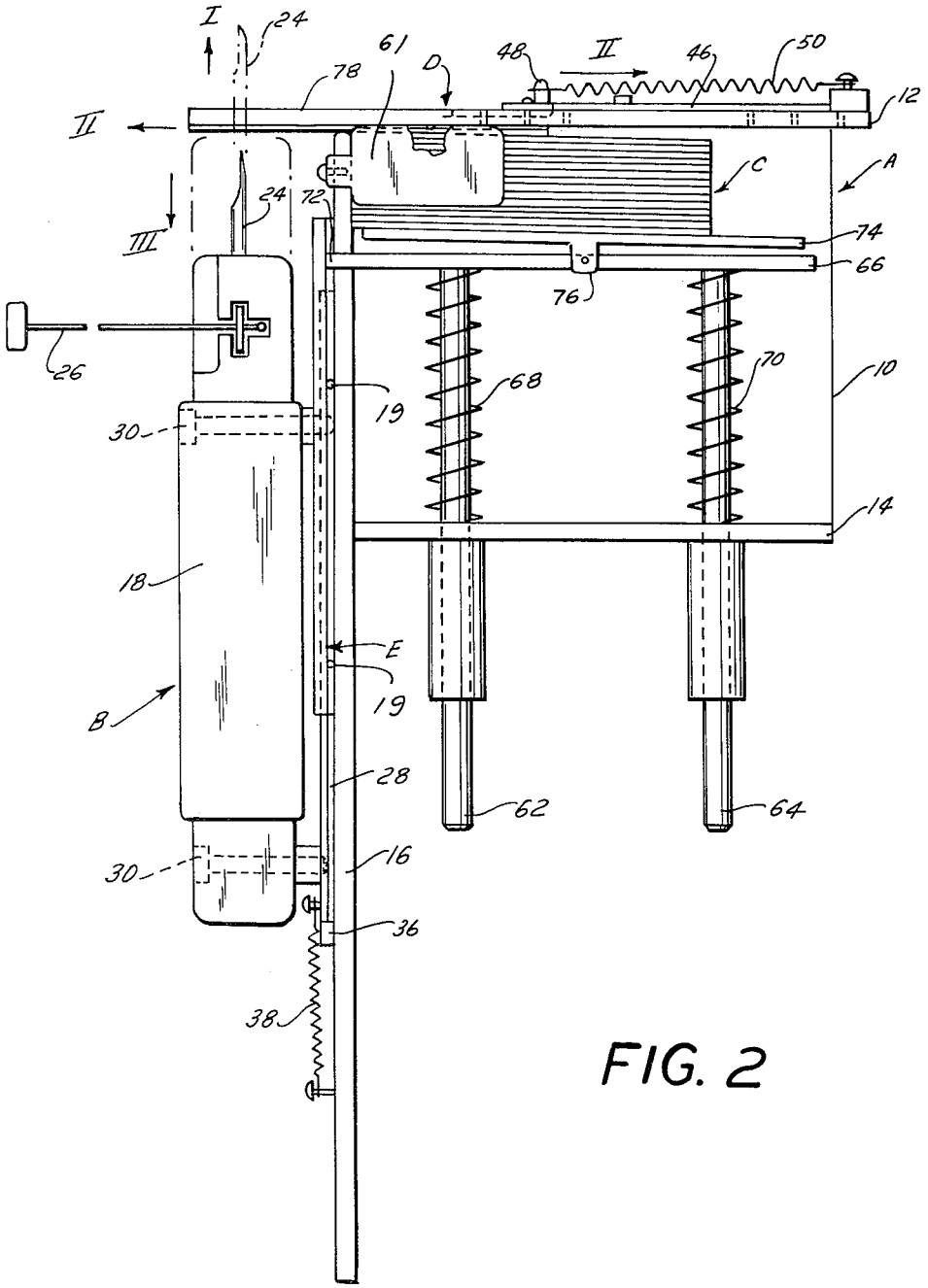
FIG. 2 is a top plan view of the device illustrated in FIG. 1.

Support A comprises a frame which includes a base member 10, upon which tag stack C rests. Affixed to the front of base member 10 is an upstanding front member 12, upon which slide means D is mounted. At the rear of base member 10 is an upstanding rear member 14 to which a means for urging the tag stack C towards front member 12 is mounted. To the left of base member 10 (as seen in FIG. 2) is an upstanding side member 16 which extends from front member 12 rearwardly past upstanding rear wall 14 a substantial distance, and to which attacher B is movably mounted by means E.

Attacher B is a commercially available hand-held plastic fastener attacher which has a body portion 18 and a handle-grip portion 20 extending downwardly from body portion 18. A spring-loaded trigger 22 is mounted on handle portion 20 and designed to be received within a recess (not shown) in handle portion 20 when the attacher is actuated by depressing trigger 22. When trigger 22 is released, it returns to the position thereof shown in FIG. 1 by means of a spring (also not shown) situated within handle 20. On the forward end of body 18 is a hollow needle 24 which is used to penetrate the tag and an article to be tagged and through which plastic fasteners 26 are dispensed.

Attacher B is fixedly mounted on a plate 28 which forms a part of means E. This is accomplished by means of a pair of screws 30 which extend through body portion 18 of attacher B and are received within internally threaded openings on plate 28 designed for this purpose.

Figures 1, 6:
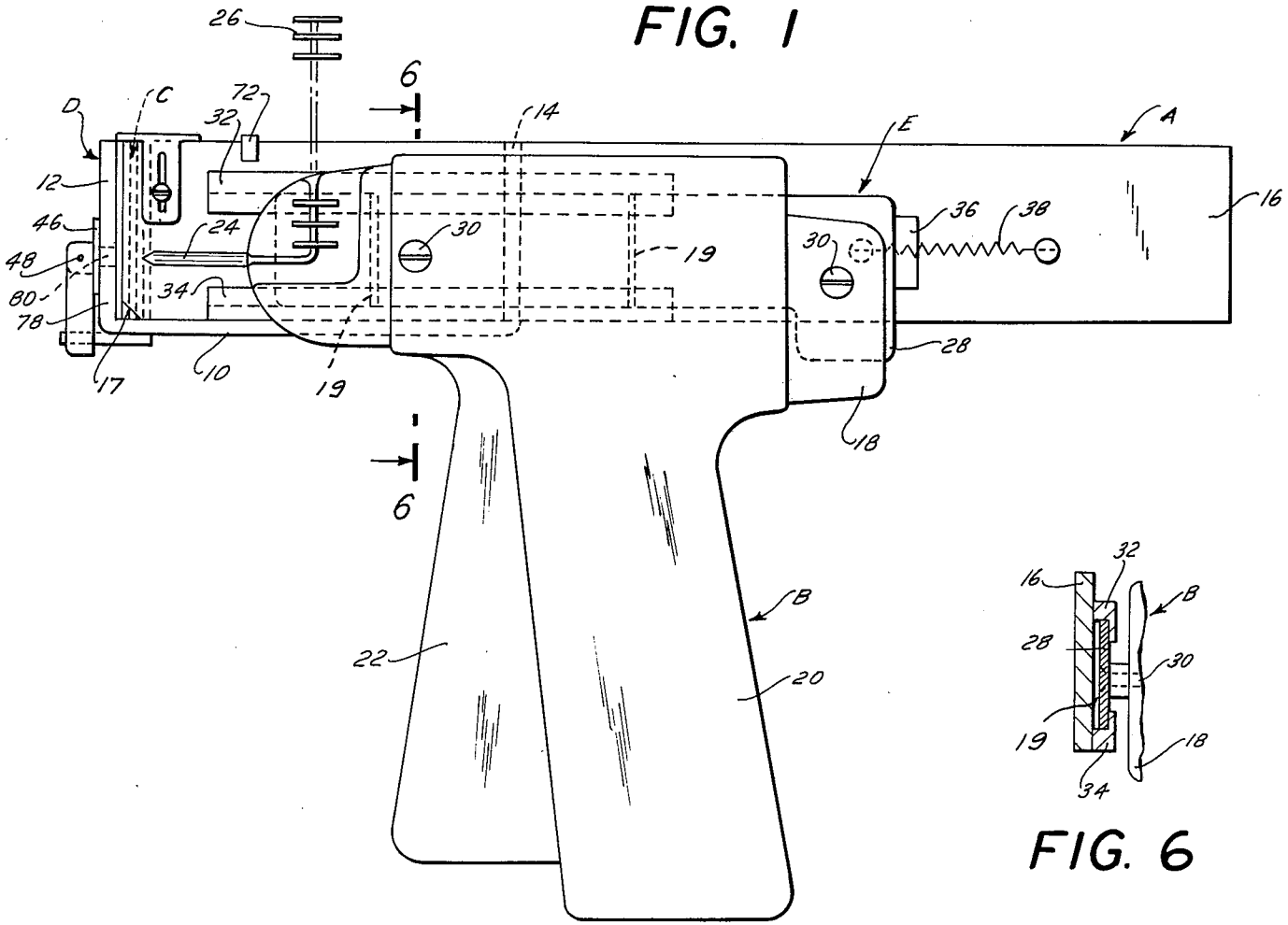
FIG. 1 is a side view of the tag dispenser of the present invention with a hand-held attacher affixed thereto.
FIG. 6 is a front view of a portion of the device, taken along line 6—6 of FIG. 1.

As is best seen in FIG. 6, a pair of "L"-shaped members 32 and 34 are mounted in spaced relation on the outer surface of side member 16. Each of the members 32, 34 has a portion which is substantially perpendicular to the surface of member 16 and extends therefrom towards attacher B a distance at least as great as the thickness of plate 28, and a second portion which is bent inwardly over the outer surface of plate 28 so as to form a channel along which plate 28 may be moved in a direction substantially parallel to side member 16. A pair of rollers 19, journaled between members 32 and 34, are provided to facilitate the movement of plate 28.

Attacher B may be moved with respect to side member 16 between a first position, as shown in FIG. 1, and in solid in FIG. 2, wherein the needle is remote from the plane of tag movement, and a second position, as shown in phantom in FIG. 2, wherein needle 24 intersects the plane of tag movement. The path of movement of attacher B is limited at its rearward end by a stop 36, extending outwardly from the surface of member 16 such that it engages the rear edge of plate 28. At its forward end, the path of movement of attacher B is limited by front member 12 and, particularly, that part thereof which extends beyond side member 16 and is aligned with the path of movement of attacher B.

A tension spring 38 is operatively connected between plate 28 and side member 16. Spring 38 serves to urge attacher B towards its initial or first position, as shown in FIG. 1. Thus, after the attacher has been moved to its second position and the tagging operation completed, the operator will release the forward pressure on the attacher as the device is withdrawn from the article, permitting spring 38 to return the attacher to its original position.

Side member 16 has a portion of the lower forward corner 17 thereof cut away, as seen in FIG. 1. This provides clearance for the forward edge of a tag, as same is fed, to prevent bending or multilation of the tag, thereby reducing the possibility of jamming.

As best seen in FIG. 3, front member 12 is provided with an elongated opening 40 therein, into which slide means D is received. A pair of members 42, 44 are mounted on the front surface of member 12, as best seen in FIG. 4, so as to form a channel within member 12 along which slide means D may be moved between a first position, wherein the slide is aligned with the tag stack C, and a second position wherein a tag is in alignment with needle 24 of attacher B.

As best seen in FIG. 5, slide means D comprises an elongated slide member 46 having a forwardly and downwardly extending projection 48 to which one end of tension spring 50 is affixed. The other end of tension spring 50 is operably connected to front member 12. Spring 50 urges slide 46 towards its first position and serves to return the slide to a position in alignment with the stack C.

Slide 46 is provided with an elongated opening therein to which a tag engaging finger 52 is position-adjustably mounted, by means of screws 54. By loosening screws 54, the position of finger 52 relative to slide 46 may be adjusted to accommodate different size tags. Finger 52 preferably takes the form of a leaf spring or the like having a base portion 56, substantially planar in nature, into which screws 54 are received, and a tag engaging portion 58, preferably integrally formed with portion 56, which is bent inwardly towards tag stack C. On the tip of engaging portion 58 are one or more teeth 60 (see FIG. 4) which are designed to engage the front surface of the top tag on the stack and to move same along with the movement of the slide. It should be noted that, unlike most devices of this type, the tag engaging finger in the present invention is not designed or located to engage the rear edge of the first tag on the stack, but instead, the front surface or face thereof. It is believed that the reliability of tag engagement is, in this manner, greatly enhanced.

It should be noted that tag stack C is confined by support A on only two sides. The bottom of the stack is supported by member 10 and the left side of the stack (as seen in FIG. 2) is adjacent side member 16. However, the top and right side of the stack are not confined, except for a position-adjustable top member 61, and, therefore, tags of a large variety of different sizes and shapes may be accommodated by the device of the present invention without structural modification thereof.

It is necessary to urge the tag stack C towards slide D such that each tag can be removed from the top of the stack in sequence. In order to accomplish this result, a pair of rearwardly extending rods 62 and 64 are provided, the forward end of each of which is fixedly mounted to a substantially planar member 66 situated on the top surface of member 10 behind stack C. Rods 62 and 64 are movably received through openings in rear member 14 provided for this purpose. A tension spring 68 is situated around the forward portion of rod 62, between members 66 and 14. Similarly, a tension spring 70 is situated around the forward end of rod 64, between members 66 and 64. Springs 68 and 70 serve to urge member 66 towards stack C. Member 66 is maintained in a position substantially perpendicular to side member 16 by means of a guide 72 and by the equal urging of springs 68 and 70.

Pivotally mounted to member 66, and situated between same and the rear end of tag stack C, is a member 74. Member 74 permits the tag stack C to pivot with respect to the plane of member 66, the movement of which is restricted to be substantially perpendicular to side member 16 by guide means 72. In this manner, jamming of the mechanism is reduced and tag feeding facilitated. The top and bottom of member 74 each have a rearwardly extending part 76 having an opening therein. Member 66 is provided at the top and bottom thereof with protrusions which are received within the openings in parts 76. This simple mechanical connection permits plate 74, and thus stack C, to pivot to a limited extent with respect to plate 66, as shown in FIG. 2.

As seen in FIG. 3, a portion 78 of front member 12 is situated in alignment with attacher B. Portion 78 acts as an abutting member to hold a fed tag in position such that needle 24 of attacher B may penetrate same as the attacher is moved towards its second position. Portion 78 is provided with an elongated slot 80 such that needle 74 can penetrate the tag and article to be tagged without being obstructed by member 12. In addition, slot 80 permits a fastener, which has been anchored on the article, to be removed from the device by a single simple motion of the operator.

The device as hertofore described can be operated manually, if desired. With the attacher in its first position, the operator engages protrusion 48 on slide means D with his finger and moves the slide from its first position, in alignment with the stack, to its second position, wherein the tag is aligned with the attacher needle. A simple mechanical latch, described below, maintains the slide in this position against the action of spring 50. The device is now ready to start the tagging operation. The device is placed against the article to be tagged with the surface thereof abutting the front surface of front member 12. Attacher B is moved forward, from its first position, wherein the needle is remote from the plane of tag movement, to its second position, where the needle intersects the plane of tag movement and the needle has penetrated the tag and the article to be tagged. The attacher, as it approaches the end of its forward path of movement, at a point where the needle has already penetrated the tag, releases the latch on the slide, permitting the slide to return to its original position through the action of spring 50. The attacher is actuated by squeezing trigger 22 to cause a plastic fastener to be dispensed through the needle such that its T-bar end is on the rear side of the article to be tagged, the paddle end is still in the needle, and the article to be tagged and the tag are on the filament of the fastener. The operator withdraws the device, causing the anchored fastener to move through slot 80 and withdraw completely from the needle. The operator then feeds another tag into position and the operation is repeated.

It is also possible with the present invention, and indeed preferable, to automate the tag feeding operation. In various preferred embodiments, described in detail below, this is done by a simple mechanical linkage, a solenoid, an electric motor, and a pneumatic cylinder.

Various preferred embodiments employing different types of automatic slide drive systems are illustrated in FIGS. 7 through 11. In each case, the basic device is identical to that which has been previously described and illustrated in FIGS. 1 through 6. For this reason, in each case, the basic device has not been shown or described, and for purposes of simplicity, only the automated drive system itself is shown.

Figure 7:
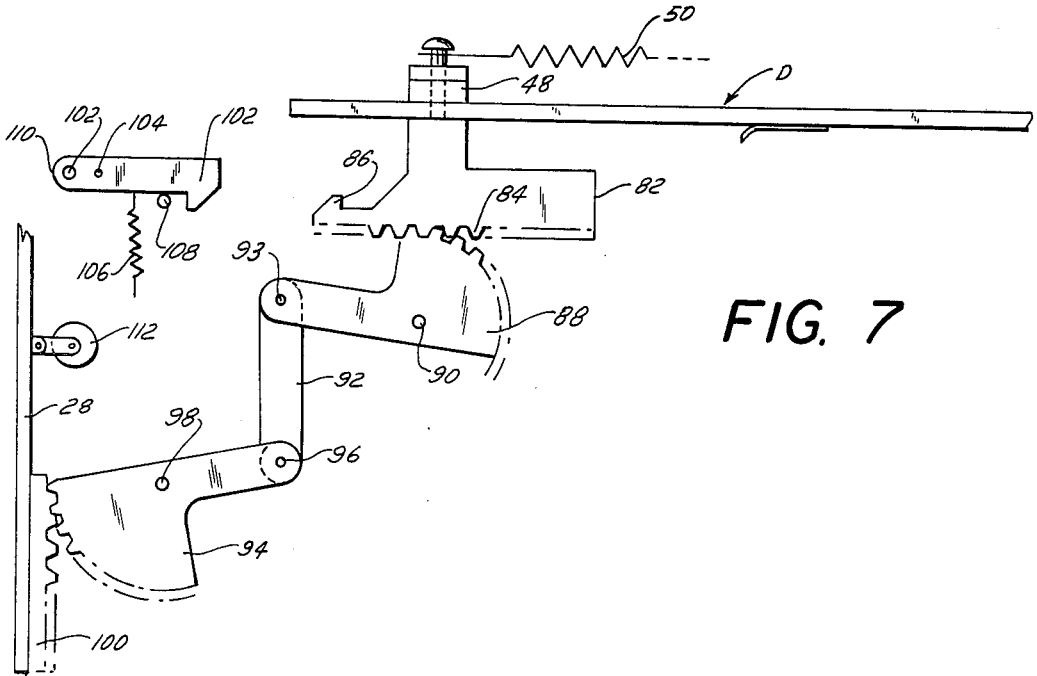
FIG. 7 is a bottom view of a mechanical linkage utilized in a preferred embodiment of the present invention.

FIG. 7 illustrates a simple mechanical linkage and latch mechanism which can be utilized to drive the tag transfer means of the present invention in accordance with the movement of attacher B relative to support A. FIG. 7 shows the parts of the mechanical linkage as if one were looking at the bottom surface of base member 10.

To finger 48, attached to slide means D, is a first member 82 which comprises a rack portion 84 and a latching tooth 86. Intermeshing with rack 84 is a gear 88 pivotally mounted to the undersurface of member 10 at point 90. The elongated end of gear 88 is pivotally connected to a link member 92, at point 93. The other end of link member 92 is pivotally connected to a second gear 94, at point 96. Gear 94 is pivotally mounted to the undersurface of member 10 at point 98. The teeth of gear 94 are situated to engage the teeth of a second rack member 100, fixedly mounted on plate 28, to which attacher B is affixed.

At a position in the path of movement of latching tooth 86, a latch 102 is pivotally mounted at point 104 to the undersurface of member 10. Latch 102 is spring-loaded towards gear 94 by means of a tension spring 106. A stop member 108 is provided such that latch 102 remains in alignment with the path of movement of latch tooth 86. One end 110 of latch 102 intersects the path of movement of a one-way roller leaf 112 fixedly mounted to plate 28.

As attached B, and thus plate 28, are moved from the first position towards the forward end of the device, the movement thereof is transferred by means of rack 100, gear 94, link member 92, gear 88 and rack 82 to slide means D, causing slide means D to move towards the left (as seen in FIG. 7) such that a tag is removed from the stack and moved into alignment with the attacher. When slide means D is in its second position, with the tag aligned with the attacher needle, latch tooth 86 is engaged by latch 102. The inclined surface of latch tooth 86 engages a similarly inclined surface on latch 102 to cam latch 102 against the urging of spring 106 such that engagement between the latch and rack 82 can be achieved.

At this point in attacher movement, the needle is still well behind the plane of tag movement, and thus the fed tag. Rack 100, however, is of limited length and, at this point in the path of movement of plate 28, rack 100 disengages from gear 94. Further forward movement of attacher B causes needle 24 to penetrate the fed tag and the article to be tagged. As attacher B returns from its second position, a one way roller leaf 112, mounted on and extending from plate 28, trips latch 102 such that rack 82, and thus slide means D, are permitted to return to their initial positions through the action of spring 50. At the same point in the path of movement of plate 28 where latch 102 is tripped, rack 100 again engages gear 94 and the cycle can be repeated.

Figure 8:
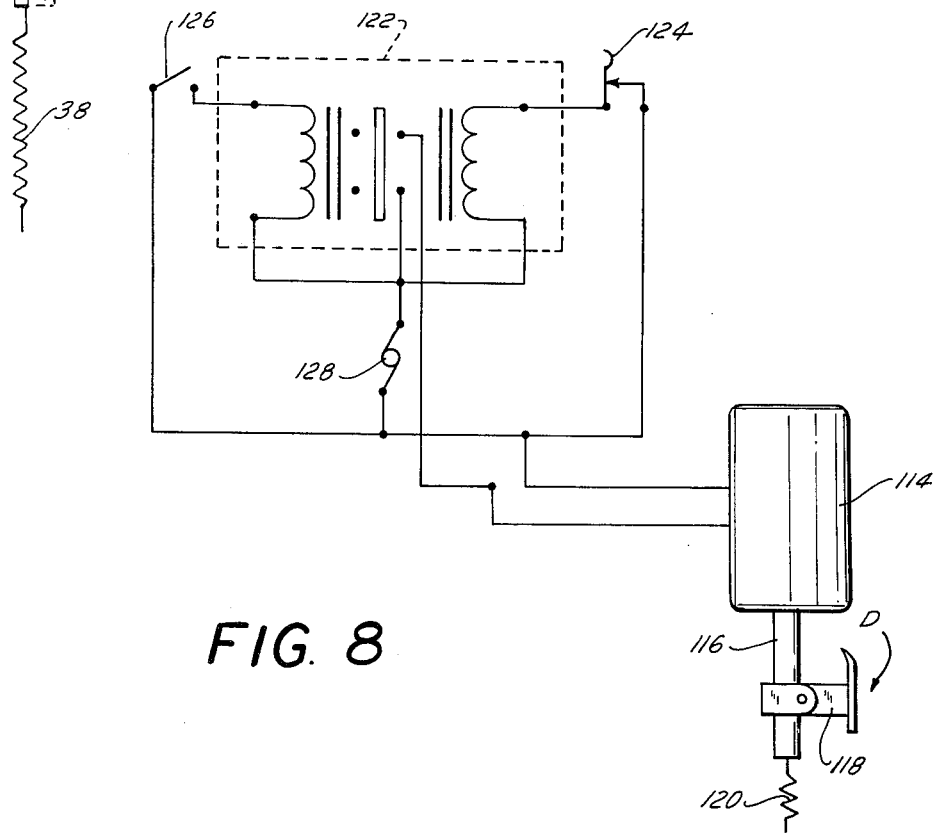
FIG. 8 is a schematic diagram of a solenoid and latching circuit utilized in a preferred embodiment of the present invention.

FIG. 8 schematically illustrates another form of the automatic slide driving mechanism which utilizes a conventional electrically actuated solenoid 114 having a rod 116 mechanically linked to slide means D by a member 118. Rod 116 is spring-loaded towards its outer position, by means of a spring 120. Solenoid 114 is controlled by means of a conventional latching relay 122 and a pair of conventional microswitches 124 and 126.

Switch 124 is normally closed and is situated on portion 78 of front member 12 so as to sense the presence of a fed tag. When a tag is present, switch 124 is held open. Switch 126 is normally open, Switch 126 is situated on side member 16 and is adapted to be tripped by a protrusion on member 28. Switch 126 will be closed by the forward movement of member 28 as attacher B approaches its second position. Latching relay 122 is energized by an electrical source 128.

Attacher B returns to its first position and switch 126 is thus opened. As the tag is removed, switch 124 closes. Closing switch 124 causes latching circuit 122 to latch to energize solenoid 114, retracting rod 116 against the action of spring 120, and slide means D is moved from its first position to its second position, feeding the next tag into position. Solenoid 114 remains energized by latching circuit 122 until attacher B is moved towards the second position, closing switch 126. Closing switch 126 causes relay 122 to de-energize solenoid 114. This permits spring 120 to cause rod 116 to extend and slide means D to return to its first position.

Figure 9:
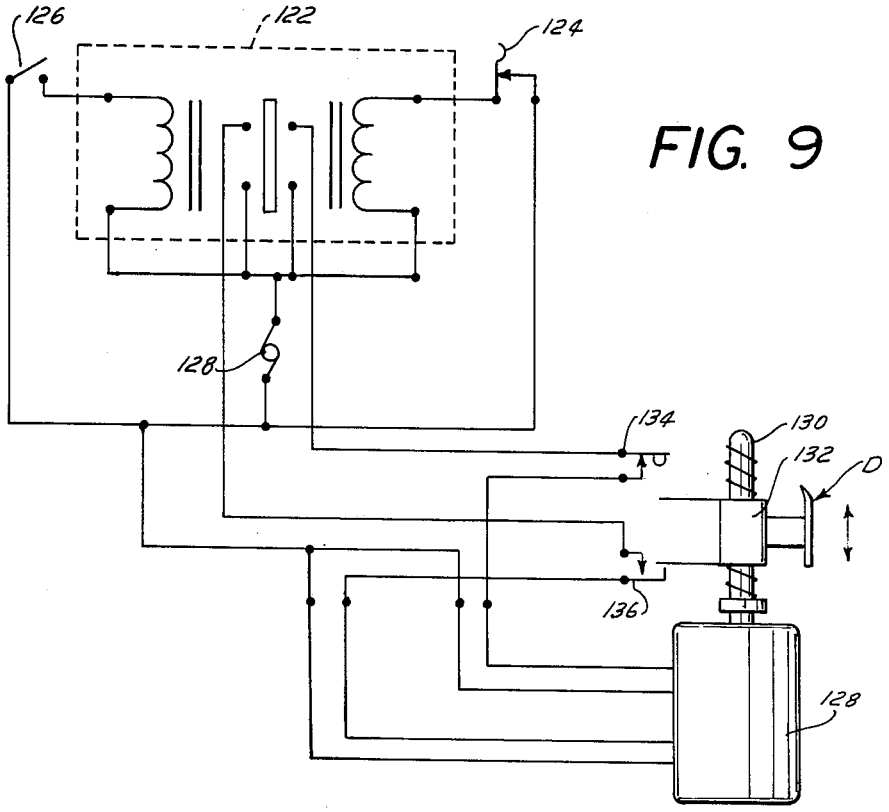
FIG. 9 is a schematic diagram of an electric motor and latching circuit utilized in a preferred embodiment of the present invention.

FIG. 9 schematically illustrates a slide drive mechanism which utilizes a conventional reversible electric motor 128 instead of a solenoid. Motor 128 has an externally threaded output shaft 130 upon which an internally threaded collar 132 is received. Key means (not shown) are provided for permitting linear displacement of collar 132 along shaft 130 without permitting rotation of collar 132. Collar 132 is connected to slide means D. In order to stop motor 128 at either end of the path of travel of collar 132, a pair of limit switches 134, 136 are mounted along the path of linear movement of collar 132.

The sequence of operation begins with collar 132 in the position shown, holding normally closed switch 136 open. Switch 126 is open because attacher B is in its first position. When the tag is removed from the device, switch 124 is closed. The closing of switch 124 causes latching relay 122 to energize motor 128 to move collar 132 such that slide means D moves to its second position, to feed the next tag, and thus open switch 124. Movement of collar 132 causes limit switch 136 to close. At the end of its path of movement, collar 132 opens limit switch 134, de-energizing the motor.

As attacher B is moved forward, switch 126 is closed, causing relay 122 to energize motor 128 in the reverse direction, moving collar 132 to close limit switch 134 and slide means D is moved to its first position. At the end of its path of travel, collar 132 opens switch 136, de-energizing the motor. When attacher B is returned to its first position, switch 126 is again opened.

Figure 10:
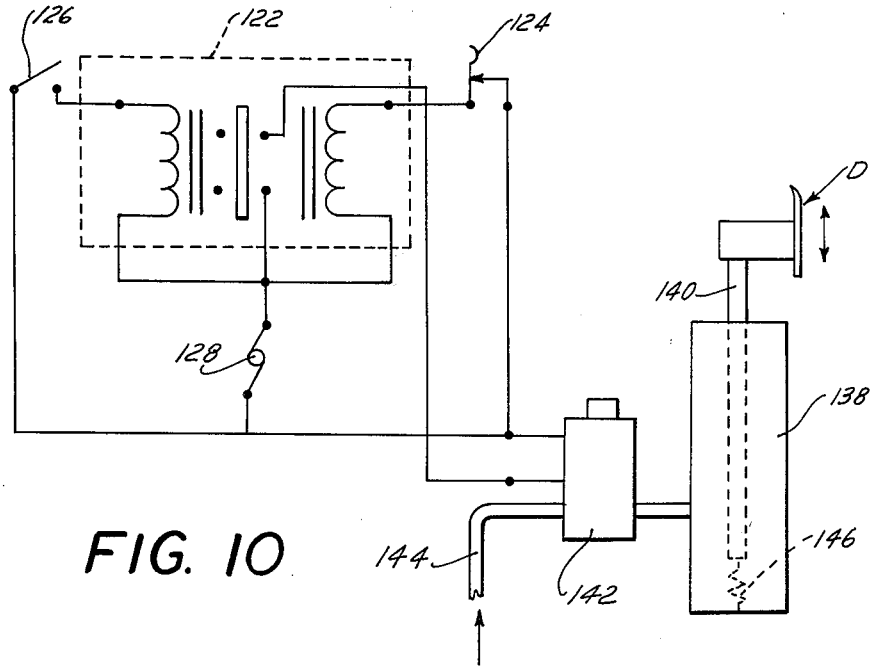
FIG. 10 is a schematic diagram of a pneumatic cylinder, a valve and a latching relay utilizable in a preferred embodiment of the present invention.

FIG. 10 illustrates an automatic slide drive mechanism which utilizes a conventional spring return pneumatic cylinder, having a rod 140 which is connected to slide means D. Pneumatic cylinder 138 is connected, through an electrically actuated valve 142 to a source of compressed air (not shown) by means of a conduit 144.

As the tagging operation is completed, attacher B returns to its first position and switch 126 is opened. The tag is removed from the device causing switch 124 to close. This causes relay 122 to energize solenoid valve 142 to connect the air source to cylinder 138, causing rod 140 to extend and slide means D to move to its second position to feed the next tag which opens switch 124.

Attacher B is then moved forward closing switch 126. Closing switch 126 causes relay 122 to de-energize solenoid valve 142, exhausting the cylinder and permitting the spring therein to return rod 140 to its retracted position, such that slide means D moves to its first position. When attacher B returns to its first position, switch 126 is again opened.

Figure 11:
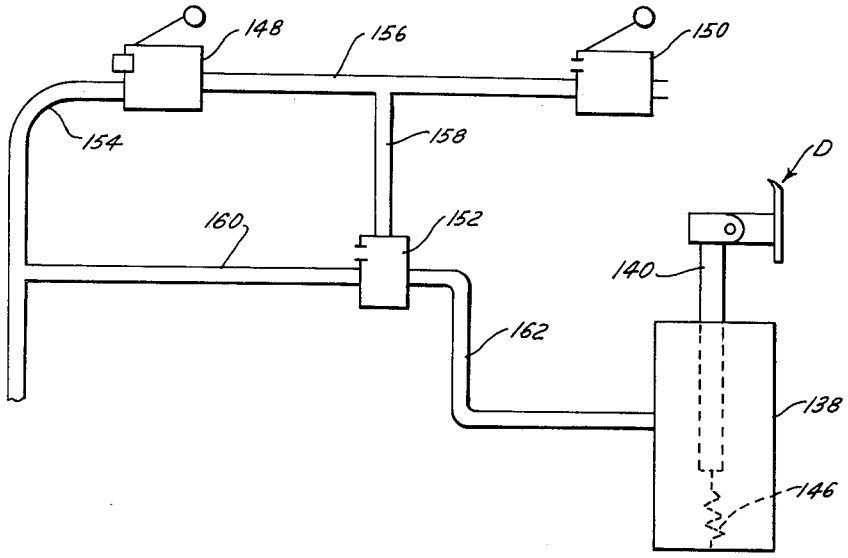
FIG. 11 is a schematic diagram of a pneumatic cylinder and the pneumatic drive apparatus, usable in a preferred embodiment of the present invention.

FIG. 11 illustrates an all pneumatic slide drive mechanism which utilizes a pneumatically driven solenoid 138 equivalent to the solenoid illustrated in FIG. 10. However, unlike the system illustrated in FIG. 10, the system illustrated in FIG. 11 is all pneumatic, as opposed to being electrical and pneumatic. The system illustrated in FIG. 11 comprises a pair of mechanically-actuated, normally closed, pneumatic valves 148 and 150 and a pneumatically controlled valve 152. Valves 148 and 150 replace switches 126 and 124. respectively.

Each of the valves 148 and 150 has an input port, an output port, an exhaust port, and a mechanically operated trigger. A source of compressed air (not shown) is connected to the input port of valve 148 by means of conduit 154. The exhaust port of valve 148 is plugged. The output port of valve 148 is connected to the input port of valve 150 by means of a conduit 156. The exhaust port of valve 150 is open. Conduit 156 is connected to the control port of valve 152 by means of conduit 158. The input port of valve 152 is connected to the pneumatic source by means of a conduit 160. The exhaust port of valve 152 is open. The output port of valve 152 is connected to pneumatic cylinder 138 by conduit 162.

After the tagging operation is complete, attached B is returned to its first position, causing valve 150 to close. Valve 148 is held open by the presence of a fed tag. When the tag is removed from the device, valve 148 closes connecting the source to conduit 156, and thus conduit 158, thereby actuating valve 152 to connect the source to cylinder 138. This causes the cylinder rod to extend and slide means D to move to the second position, feeding the next tag and opening valve 148. However, the exhaust of valve 148 is plugged, such that valve 152 remains actuated, retaining the cylinder rod in the extended position, until valve 150 opens.

When attacher B is moved forward, valve 150 is opened, releasing the pressure in conduits 156 and 158, thus deactuating valve 152, such that the source is no longer connected to cylinder 138. This causes the spring to retract the cylinder rod, thus returning slide means D to its first position. As attacher B is returned to its first position, valve 150 again closes. However, valve 152 is not actuated again until valve 148 is closed by the removal of the fed tag from the device.

It will now be appreciated that the present invention relates to a tag dispensing device designed for use in conjunction with a hand-held plastic fastener attacher. The basic device incorporates a support upon which a stack of tags is situated and to which a commercially available attacher is movably mounted. Slide means are provided for moving a tag from the stack into alignment with the attacher. Once the tag is positioned, the attacher can be moved forward, relative to the support, such that the needle penetrates the tag and the article to be tagged. The attacher may then be actuated and the forward pressure thereon released such that the attacher returns to its original position. The dispensed fastener and the tag mounted thereon may then be removed from the device.

Various methods of automatically actuating slide means movement in conjunction with the movement of the attacher relative to the support are provided. These drive systems incorporate mechanical linkages, solenoids, motors or pneumatic cylinders, as well as the appropriate electrical or mechanical latching mechanisms.

While only a limited number of preferred embodiments have been disclosed herein for purposes of illustration, it is obvious that many modifications and variations could be made thereto. It is intended to cover all of these variations and modifications which fall within the scope of the present invention, as defined by the following claims.

I claim:

1. In combination, a hand-held manually actuated fastener attacher of the type having a hollow needle designed to penetrate a tag and an article to be tagged and through which a fastener is dispensed and a portable tag feeding device, the device comprising: a support; means for mounting a stack of tags on said support; tag transfer means; means for mounting said transfer means on said support for movement along a first position, aligned with said stack mounting means wherein a tag is engaged, and a second position, wherein a tag is aligned with the needle; means for mounting said support to the fastener attacher for relative manual movement therebetween, between an initial position, wherein said needle is spaced from said plane, and a second position, wherein said needle intercepts said plane; means for biasing said tag transfer means toward said first position; and means for latching said tag transfer means in said second position.

2. The combination of claim 1, wherein said support comprises tag retaining means having an opening therein aligned with said needle.

3. In combination, a hand-held manually actuated fastener attacher of the type having a hollow needle designed to penetrate an article to be tagged and through which a fastener is dispensed, and a portable tag feeding device, the device comprising: a support; means for mounting a stack of tags on said support; tag transfer means; means on said support for retaining a tag in alignment with said needle; means for mounting said tag transfer means on said support for movement between a first position, aligned with said stack mounting means, wherein a tag is engaged by said tag transfer means, and a second position, wherein a tag is aligned with said tag retaining means; means for mounting said support to the fastener attacher for relative manual movement therebetween, between an initial position, wherein said needle is spaced from said tag retaining means, and a second position, wherein said needle penetrates the tag aligned with said tag retaining means.

4. The combination of claim 3, wherein said tag retaining means comprises an abutting surface situated to abut the surface of the tag opposite from that which faces the needle.

5. The combination of claim 4, wherein said abutting surface comprises an opening therein aligned with said needle.

6. The combination of claim 3, wherein said support comprises a part elongated in a direction substantially parallel to the direction of said relative movement and wherein said support mounting means comprises a member, means for fixedly mounting said attacher to said member and means for movably mounting said member relative to said support part.

7. The combination of claim 6, wherein said support part has a portion adjacent said plane, said portion having a cut-away section to provide clearance for the edge of a tag as said tag transfer means is moved from said first position to said second position.

8. The combination of claim 7, wherein said section is the corner of said support part.

9. The combination of claim 6, wherein said member mounting means comprises a channel on said support part within which said member is movably received and means, operably connected between said member and said support part, for urging said member towards a position wherein said attacher is in said initial position.

10. The combination of claim 3, wherein said stack has a bottom, two sides and a top, and wherein said stack mounting means comprises means for supporting the bottom of the stack and means for supporting one side of the stack, the top and the other side of the stack having no confining structure.

11. The combination of claim 10, wherein said means for supporting one side of the stack comprises the member of said support to which said attacher mounting means is mounted.

12. The combination of claim 3, wherein said transfer means mounting means comprises a member mounted on said support and extending between said stack mounting means and a position aligned with the axis of the needle and a channel on said mounting means member into which a slide is movably received.

13. The combination of claim 12, wherein the portion of said mounting means member aligned with the axis of the needle comprises tag support means and an opening in said tag support means aligned with the axis of the needle.

14. The combination of claim 13, wherein said opening comprises a slot connecting said opening and the edge of said tag support means.

15. The combination of claim 14, wherein said slot is substantially parallel to the direction of movement of said slide means.

16. The combination of claim 3, wherein said transfer means comprises a slide and a tag engaging finger mounted on said slide.

17. The combination of claim 16, wherein said slide has an elongated slot and means for mounting said finger along said slot.

18. The combination of claim 17, wherein said finger mounting means comprises means for adjustably positioning said finger along said slot.

19. The combination of claim 16, wherein said finger comprises a body and means, mounted on said finger body, for engaging the surface of a tag.

20. The combination of claim 19, wherein said surface engaging means comprises a tooth extending from said finger body in a direction towards said stack mounting means.

21. The combination of claim 20, wherein said tooth is integral with said finger body.

22. The combination of claim 19, wherein said surface engaging means comprises a pair of teeth mounted to said finger body in side-by-side relation.

23. The combination of claim 19, wherein said surface engaging means comprises a bifuricated section of said finger body.

24. The combination of claim 3, wherein said stack mounting means comprises means for urging the stack towards said plane, said urging means comprising a first spring load member, means for orienting said first member in a plane substantially parallel to said plane of movement of said slide means, a second member interposed between said first member and the rear of the stack and means for pivotally mounting said second member to said first member.

25. The combination of claim 24, wherein said orientating means comprises means for guiding said first member for movement along said support in a direction substantially parallel to the direction of attacher movement.

26. The combination of claim 3, further comprising means for latching said transfer means in said second position.

27. The combination of claim 3, further comprising means for moving said transfer means between said first and second positions.

28. The combination of claim 27, wherein said transfer means moving means comprises a mechanical linkage operably connected between said transfer means and said support mounting means.

29. The combination of claim 28, further comprising means for latching said transfer means in said second position.

30. The combination of claim 29, wherein said latching means comprises a mechanical latch operably positioned to engage a portion of said linkage when said transfer means is in said second position.

31. The combination of claim 30, wherein said linkage is disengaged from said attacher mounting means during a portion of the movement of said attacher from said first to said second position.

32. The combination of claim 27, wherein said transfer means moving means comprises a pneumatic cylinder, means for operably connecting said cylinder to said transfer means and means for actuating said cylinder.

33. The combination of claim 27, wherein said transfer means moving means comprises a solenoid, means for operably connecting said solenoid to said transfer means and means for actuating said solenoid in accordance with the movement of said support mounting means.

34. The combination of claim 27, wherein said moving means comprises a motor, means for operably connecting said motor to said transfer means, and means for actuating said motor to move said transfer means in accordance with the movement of said attacher mounting means.

35. The combination of claim 27, wherein said moving means comprises a protrusion situated on said transfer means and adapted to be engaged by the finger of the operator.

* * * * *